US005353860A

United States Patent [19]

Staub et al.

[11] Patent Number: 5,353,860

[45] Date of Patent: Oct. 11, 1994

[54] CASTING UNIT FOR THE MANUFACTURING OF A PLURALITY OF CAST PARTS

[75] Inventors: Fritz Staub, Seuzach; Daniel Stahl, Ossingen, both of Switzerland; Jürgen Wortmann, Weichs, Fed. Rep. of Germany

[73] Assignee: Sulzer-MTU-Casting Technology GmbH, Fed. Rep. of Germany

[21] Appl. No.: 43,481

[22] Filed: Apr. 6, 1993

[30] Foreign Application Priority Data

Apr. 13, 1992 [DE] Fed. Rep. of Germany ..... 4212410

[51] Int. Cl.[5] ..... B22D 27/04

[52] U.S. Cl. ..... 164/122.1; 164/361

[58] Field of Search ..... 164/361, 122.1, 122.2

[56] References Cited

U.S. PATENT DOCUMENTS 3,763,926 10/1973 Tschinkel .

5,269,365 12/1993 Lallement et al. ..... 164/122.2

FOREIGN PATENT DOCUMENTS 0477136 8/1991 European Pat. Off. .

*Primary Examiner*—Kuang Y. Lin

*Attorney, Agent, or Firm*—Evenson, McKeown, Edwards & Lenahan

[57] ABSTRACT

A casting unit for the manufacturing of a plurality of cast parts by using directed solidification or monocrystal formation as well as the process for casting is provided. A plurality of individual molds are combined while forming close distances to form a mold shell in the manner of an array. In this manner, the simultaneous casting of a large number of cast parts is permitted while the space requirement is minimized.

10 Claims, 2 Drawing Sheets

CASTING UNIT FOR THE MANUFACTURING OF A PLURALITY OF CAST PARTS

BACKGROUND OF THE INVENTION

This invention relates to a casting unit for the manufacturing of a plurality of cast parts by directed solidification or monocrystal formation using a mold shell comprising a plurality of individual molds corresponding to the cast parts, and having a cooling plate which forms a lower end of the mold shell, as well as to a process using such a casting unit.

A casting unit of this type is known from the European Patent Document EP-A-0 477 136. In this patent document, a casting unit is described in the case of which the individual cast parts are arranged in a cluster form in a circular shape around a central trunk. By means of the centric arrangement of the individual molds, it is ensured that the same conditions exist for all cast parts with respect to the thermal economy during the solidification and thus the directing of the solidification front is the same in each cast part. As a result, the same quality can be achieved for each cast part.

It is a disadvantage of the known casting unit that, when the number of individual molds per casting unit is to be increased in order to increase the economy during the casting, the diameter of the casting unit must be increased, which requires larger and therefore more expensive furnaces. On the other hand, a free space is created in the interior of the circularly arranged individual molds which is not utilized. If individual molds were to be arranged also in this inner free space, the requirement of the same thermal economy for all individual molds or cast parts during the solidification could not easily be met. For solving this problem, the U.S. Pat. No. 3,763,926 teaches the cooling of the individual molds using a tin melt which, however, causes considerable manufacturing expenditures.

There is therefore needed a casting unit of the above-mentioned construction in the case of which a number of cast parts that is as large as possible can be manufactured simultaneously and with low constructional expenditures.

SUMMARY OF THE INVENTION

These needs are met, according to the present invention in that, in the case of the casting unit of the above-mentioned type, the individual molds of the mold shell, while maintaining narrow distances, are arranged according to an array, having rows and columns arranged orthogonally to each other, and the totality of the individual molds is surrounded by a ring of heat sources integrated in the mold shell.

The important advantage of the casting unit according to the present invention is the fact that, by using the arrangement of the individual molds in an array, a maximal number of individual molds and thus cast parts can be cast on a predetermined base area and therefore in a predetermined space. The heat sources integrated into the mold shell on the periphery are used for the compensation of the heat economy of the individual edge-standing molds.

In the case of a first preferred embodiment of the casting unit according to the present invention, the heat sources are constructed as accumulations of material in the edge area of the mold shell. As a result of the accumulations of material, the edge area of the mold shell may locally have an increased heat capacity and may therefore, as a heat reservoir or a heat source, control the course of the temperature in the solidifying cast part.

In a further development of the invention, the heat Sources integrated in the mold shell may be hollow bodies which can be filled with the melt. According to the size of the hollow bodies, their heat capacity can be precisely adjusted and thus the course of the temperature or heat flow in the solidifying cast part can be controlled very well.

Preferably, the heat capacity of the heat sources is adapted to the heat capacity of the casting unit such that the lateral heat flow to the individual molds of the mold shell arranged on the exterior rows and columns of the array is at least approximately the same as that of the lateral heat flow from interior molds in the array. In this case, the heat flow to the edge-standing individual molds from the direction of the interior side is the result of the adjacent individual molds which are situated in the central area of the casting unit.

Furthermore, the invention relates to a process for the manufacturing of cast parts via a directed solidification or monocrystal formation in a vacuum casting installation. A casting process of this type is again disclosed in the European Patent Document EP-A 0 477 136. An important characteristic of such a process consists of generating a controlled heat flow for the directing of the solidification front in order to achieve the directed solidification or monocrystal formation. It is known to generate such a controlled heat flow by using heating elements with an outside energy supply (susceptors).

The present invention improves a process of this type by using a casting unit according to the present invention. As a result, heating elements with an outside energy supply become superfluous, and the heat flow and thus the temperature course in the solidifying cast parts can nevertheless be controlled in a precise manner.

In the case of the process according to the invention, the casting unit is preferably heated before the casting outside the vacuum casting installation to a temperature which is at least 50°K higher than the liquid temperature of the casting material.

In a further development of the process according to the invention, the course of the temperature can be controlled during the solidification of the melt by the isolation of the individual molds of the casting unit. Finally, a further development according to the invention is possible in that the course of the temperature is controlled using reflectors which surround the casting unit and, as a result, reflect the heat radiated from it particularly to the edge-standing individual molds.

Other objects, advantages and novel features of the present invention will become apparent from the following detailed description of the invention when considered in conjunction with the accompanying drawings.

DETAILED DESCRIPTION OF THE DRAWINGS

Figure 1:
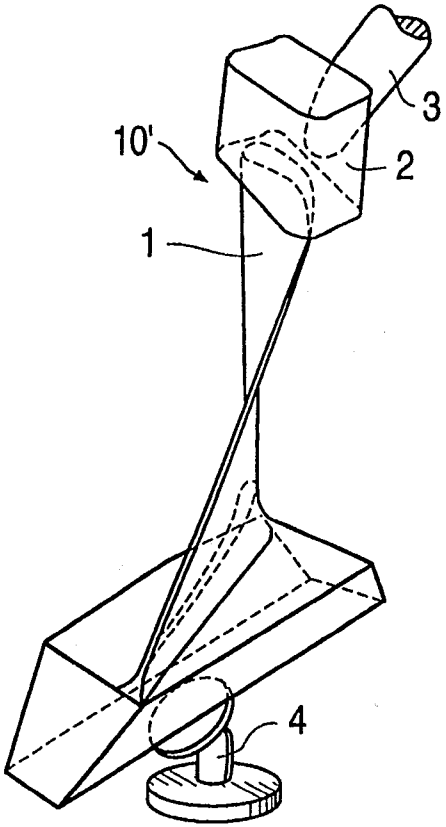
FIG. 1 is a perspective view of the wax mold of a cast part to be manufactured which, in this case, is a turbine blade.

The turbine blade illustrated in FIG. 1 as a wax model 1 is to be manufactured as a monocrystal cast part. On the head of the turbine blade, the wax mold has a heat reservoir 2 and a feeding duct 3. On the foot of the blade, the wax mold has a so-called selector 4 which is required for the construction of a monocrystal.

Figure 2:
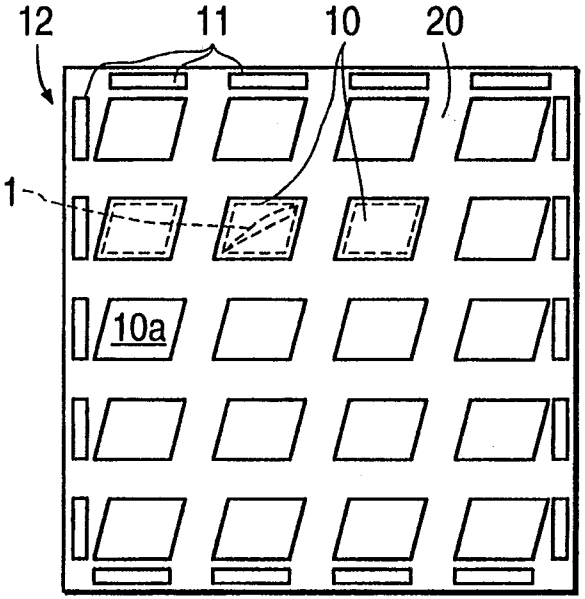
FIG. 2 is a cross-sectional schematic view of a first basic embodiment of the mold shell of a casting unit according to the invention.

FIG. 2 illustrates a schematic cross-sectional view of a casting unit for the manufacturing of a plurality of blades according to FIG. 1. The casting unit comprises a mold shell 12 which includes a plurality of individual molds 10 corresponding to the wax models 1. As illustrated in FIG. 2, the individual molds 10 are arranged in a rectangular array having orthogonal rows and columns while maintaining close distances from one another. In this case, the feeding ducts 3 of the individual molds are combined to form a common sprue, i.e., the mold shell 12 is open on top. The mold shell 12 is also open on the bottom and is placed directly on a cooling plate 20 which the melt will contact directly. For the casting, the casting unit is placed in a vacuum casting installation which is not shown. The totality of the individual molds 10 is surrounded by a ring of heat sources 11 integrated in the mold shell 12 which, with respect to their heat capacity, are adapted to the heat capacity of the casting unit in such a manner that the lateral heat flow to the edge-standing individual molds 10*a* of the mold shell 12 from the exterior side to the interior side is at least approximately the same. Thus, by using the heat sources 11, a precisely predetermined controlled heat flow is generated in order to direct the solidification front in a desired manner.

Figure 4:
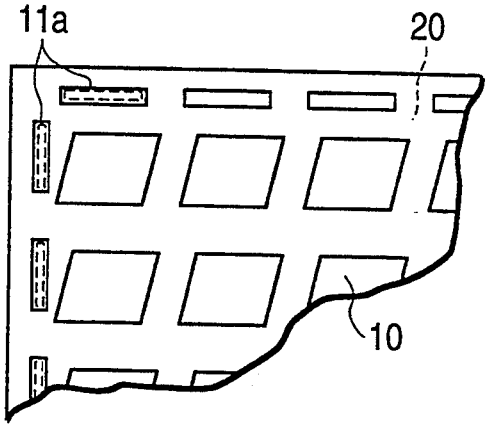
FIG. 4 is a sectionally enlarged cross-sectional view corresponding to FIG. 2, however, with hollow bodies arranged in the edge area of the mold shell constructed for receiving the melt.
Figure 5:
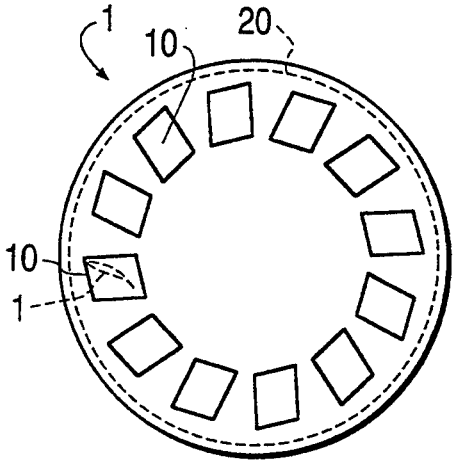
FIG. 5 PRIOR ART
FIG. 5 is a cross-sectional view corresponding to FIG. 2 of a casting unit with circularly arranged individual molds according to the prior art.

In the case of the first embodiment according to FIG. 2, the heat sources 11 are constructed only as accumulations of material in the edge area of the mold shell 12. This may be sufficient because, as a rule, the mold shells consist of ceramic materials and thus have sufficient heat capacity. As illustrated in FIG. 4, as an alternative, the heat sources may also be constructed as hollow bodies 11*a* which can be filled with melt. In this case, the heat capacity of the melt will then mainly be used as the heat source for generating a controlled heat flow.

Figure 3:
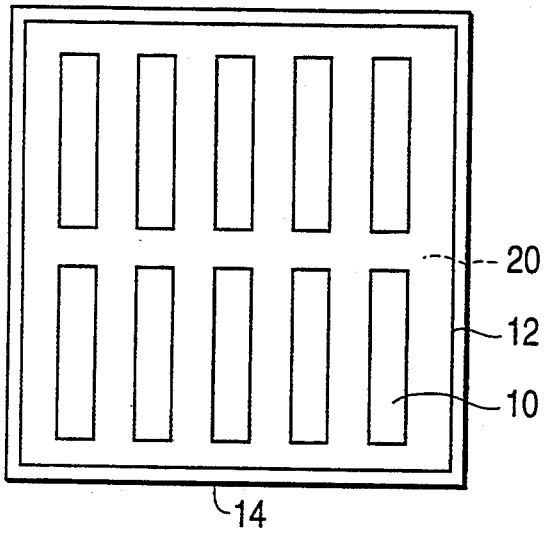
FIG. 3 is a view of an alternative embodiment of a mold shell in a representation corresponding to FIG. 2.

Finally, a process for the casting of directedly solidified cast parts, in the case of which an above-described casting unit is used for the control of the course of the temperature during the solidification of the melt, may also use the isolation of the individual molds of the casting unit or, for the control of the course of the temperature, the whole casting unit may be surrounded by reflectors 14, as indicated, for example, in FIG. 3. In this case, the casting unit must not be surrounded uniformly on all sides by reflectors 14 but, particularly when cast parts are involved as they are indicated in FIG. 3, specifically those of a plate-type geometry, the partial arrangement of reflectors on the circumference of the casting unit may also generate the desired controlled heat flow.

Finally, it should be stressed that a process according to the present invention for the manufacturing of cast parts by directed solidification or monocrystal formation preferably comprises the heating of the casting unit before the casting outside the vacuum casting installation to a temperature of at least 50°K higher than the liquid temperature of the casting material in order to thus provide to the casting unit a sufficiently high heat capacity for the control of the solidification.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. A casting unit for manufacturing a plurality of cast parts by one of directed solidification and monocrystal formation, comprising:

a mold shell including a plurality of individual molds corresponding to the cast parts, said mold shell having a cooling plate forming a lower end of the mold shell;

wherein the individual molds are arranged in an array maintaining narrow distances between the individual molds; and a ring of heat sources integrated in the mold shell surrounding the array of individual molds.

2. A casting unit according to claim 1, wherein the heat sources are constructed as accumulations of material in an edge area of the mold shell.

3. A casting unit according to claim 1, wherein the heat sources are hollow bodies which are filled with melt.

4. A casting unit according to claim 1, wherein the heat capacity of the heat sources is adapted to the heat capacity of the casting unit in such a manner that the lateral heat flow to the edge-standing individual molds of the mold shell of the exterior side and of the interior side is at least approximately the same.

5. A casting unit according to claim 2, wherein the heat capacity of the heat sources is adapted to the heat capacity of the casting unit in such a manner that the lateral heat flow to the edge-standing individual molds of the mold shell of the exterior side and of the interior side is at least approximately the same.

6. A casting unit according to claim 3, wherein the heat capacity of the heat sources is adapted to the heat capacity of the casting unit in such a manner that the lateral heat flow to the edge-standing individual molds of the mold shell of the exterior side and of the interior side is at least approximately the same.

7. A process for manufacturing cast parts by directed solidification or monocrystal formation in a vacuum casting installation, the process comprising the steps of:

using a casting unit including a mold shell including a plurality of individual molds corresponding to the cast parts, said mold shell having a cooling plate forming a lower end of the mold shell; wherein the individual molds are arranged in an array maintaining narrow distances between the individual molds; a ring of heat sources integrated in the mold shell surrounding the array of individual molds; and adapting the heat capacity of the heat sources to the heat capacity of the casting unit in such a manner that the lateral heat flow to the edge-standing individual molds of the mold shell of the exterior side and of the interior side is at least approximately the same.

8. A process according to claim 7, further comprising the step of heating the casting unit before the casting outside the vacuum casting installation to a temperature which is at least 50°K higher than the liquid temperature of the casting material.

9. A process according to claim 7, further comprising the step of controlling, during the solidification of the melt, the course of the temperature by reflectors surrounding the casting unit.

10. A process according to claim 8, further comprising the step of controlling, during the solidification of the melt, the course of the temperature by reflectors surrounding the casting unit.

* * * * *